US007881644B2

(12) United States Patent
Okamoto et al.

(10) Patent No.: US 7,881,644 B2
(45) Date of Patent: Feb. 1, 2011

(54) DEVELOPING DEVICE AND IMAGE FORMING APPARATUS

(75) Inventors: Katsumi Okamoto, Azumino (JP); Koji Migita, Matsumoto (JP); Makoto Sato, Matsumoto (JP); Takeshi Aoki, Matsumoto (JP); Masashi Nakatsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 166 days.

(21) Appl. No.: 12/407,080

(22) Filed: Mar. 19, 2009

(65) Prior Publication Data

US 2009/0245880 A1 Oct. 1, 2009

(30) Foreign Application Priority Data

Mar. 31, 2008 (JP) ..... 2008-089103

(51) Int. Cl.
*G03G 15/08* (2006.01)

(52) U.S. Cl. ..... 399/258

(58) Field of Classification Search ..... 399/257, 399/254, 258, 262

See application file for complete search history.

(56) References Cited

U.S. PATENT DOCUMENTS 6,882,816 B2 * 4/2005 Tamai ..... 399/254
2008/0166162 A1 * 7/2008 Hayashi et al.

FOREIGN PATENT DOCUMENTS

| | | | |
|---|---|---|---|
| JP | 11-249366 | | 9/1999 |
| JP | 2000-181216 | | 6/2000 |
| JP | 2000214687 A | * | 8/2000 |
| JP | 2002-091147 | | 3/2002 |

* cited by examiner

*Primary Examiner*—Susan S Lee
(74) *Attorney, Agent, or Firm*—Workman Nydegger

(57) ABSTRACT

A developing device includes: a developer carrier that carries toner thereon; a toner supply member that supplies toner to the developer carrier; a development chamber having the developer carrier and the toner supply member; a replaceable toner cartridge that supplies toner to the development chamber and collects toner from the development chamber; and a contact member that is in contact with the toner supply member to form a nip portion. At the time of replacement to the toner cartridge that contains new toner therein, the new toner is supplied from the toner cartridge into the development chamber and is made to pass through a nip portion between the toner supply member and the contact member within the development chamber, and then nip-passed toner is collected from the development chamber into the toner cartridge.

8 Claims, 8 Drawing Sheets

DEVELOPING DEVICE AND IMAGE FORMING APPARATUS

BACKGROUND

1. Technical Field

The present invention relates to a developing device that develops an electrostatic latent image on a latent image carrier with a developer and an image forming apparatus.

2. Related Art

An electrophotographic recording type image forming apparatus that forms an electrostatic latent image based on image data on a surface of a latent image carrier by exposure is known. In the image forming apparatus, an image is formed by developing the electrostatic latent image with toner by a developing device and transferring the toner image on the surface of the latent image carrier onto a recording medium, such as recording paper. In recent years, such type of image forming apparatus is generally designed such that a toner cartridge, which is formed as one body with a developing device or separately from the developing device and which contains toner therein, is detachably mounted. When the contained toner is consumed by repeatedly developing an electrostatic latent image on a surface of a latent image carrier, toner for developing the electrostatic latent image on the surface of the latent image carrier is filled up by replacing the toner cartridge.

In such a developing device, the charging ability of toner deteriorates since the toner in a development chamber is stirred for a long time by a stirring member, a toner supply roller, and a regulation blade. When new toner and deteriorated toner remaining in the development chamber are used in a state where the new toner and the deteriorated toner are stirred to be mixed in the development chamber by replacement of a toner cartridge, the new toner with the high charging ability is selectively charged and charging of the deteriorated toner becomes insufficient. As a result, since the charged amount of the whole toner that is stirred to be mixed is not sufficient, regulation passing failure or adhesion (fogging) onto a non-image area occurs. In order to prevent this, JP-A-2000-181216 discloses a technique for processing of toner remaining in a development chamber. In this technique, a driving time of a developing device is counted, forcible writing is performed in a non-image area according to the driving time, and toner, the charging ability of which has deteriorated, within the development chamber is consumed.

However, in the known techniques, toner particles with different deterioration states (charging abilities) are mixed in the development chamber. Accordingly, regulation failure, fogging, and the like may occur because the toner particles with different charged amounts are mixed.

SUMMARY

An advantage of some aspects of the invention is that it provides a developing device and an image forming apparatus capable of reducing occurrence of fogging and the like.

According to an aspect of the invention, a developing device includes: a developer carrier that carries toner thereon; a toner supply member that supplies toner to the developer carrier; a development chamber having the developer carrier and the toner supply member; a replaceable toner cartridge that supplies toner to the development chamber and collects toner from the development chamber; and a contact member that is in contact with the toner supply member to form a nip portion. At the time of replacement to the toner cartridge that contains new toner therein, the new toner is supplied from the toner cartridge into the development chamber and is made to pass through a nip portion between the toner supply member and the contact member within the development chamber, and then nip-passed toner is collected from the development chamber into the toner cartridge. Then, a difference between the fluidity or charged amount of the nip-passed toner, which was supplied again from the toner cartridge into the development chamber, and that of deteriorated toner, the charging ability of which has deteriorated since the toner was stirred for a long time by the stirring member, the toner supply roller, and the regulation blade in the development chamber, becomes small. As a result it becomes possible to reduce occurrence of fogging and the like.

In addition, all of the new toner in the toner cartridge may be supplied into the development chamber. In this case, it becomes possible to further reduce occurrence of fogging and the like.

In addition, the developer carrier may also serve as the contact member. In this case, since the number of components is reduced, the cost can be saved.

In addition, a sealing member used for sealing between the development chamber and the developer carrier may be further provided, and the developer carrier may not rotate at the time of nip pass within the development chamber. In this case, the amount of toner leaking toward the photoconductor can be reduced.

In addition, the toner supply member may be rotatable positively or negatively around a shaft. In this case, the rotation direction can be selected according to the situation.

In addition, the toner cartridge may have a cartridge stirring member, and the cartridge stirring member may further stir the nip-passed toner within the toner cartridge after the nip-passed toner is collected from the development chamber into the toner cartridge. In this case, it becomes possible to make the charged amount of toner more uniform.

In addition, a first transport path that connects a lower portion of the toner cartridge and an upper portion of the development chamber with each other and a second transport path that connects a lower portion of the development chamber and an upper portion of the toner cartridge with each other may be provided. In this case, it is possible to move toner smoothly.

Moreover, according to another aspect of the invention, an image forming apparatus includes at least: a latent image carrier on which an electrostatic latent image is formed; a developing device that develops the electrostatic latent image with a developer to form a toner image on the latent image carrier; a transfer unit that transfers the toner image on the latent image carrier onto a transfer material; and a fixing unit that fixes the toner image on the transfer material. Since the above-described developing device is mounted, a high-quality image can be formed with an almost uniform charged amount.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings.

Figure 1:
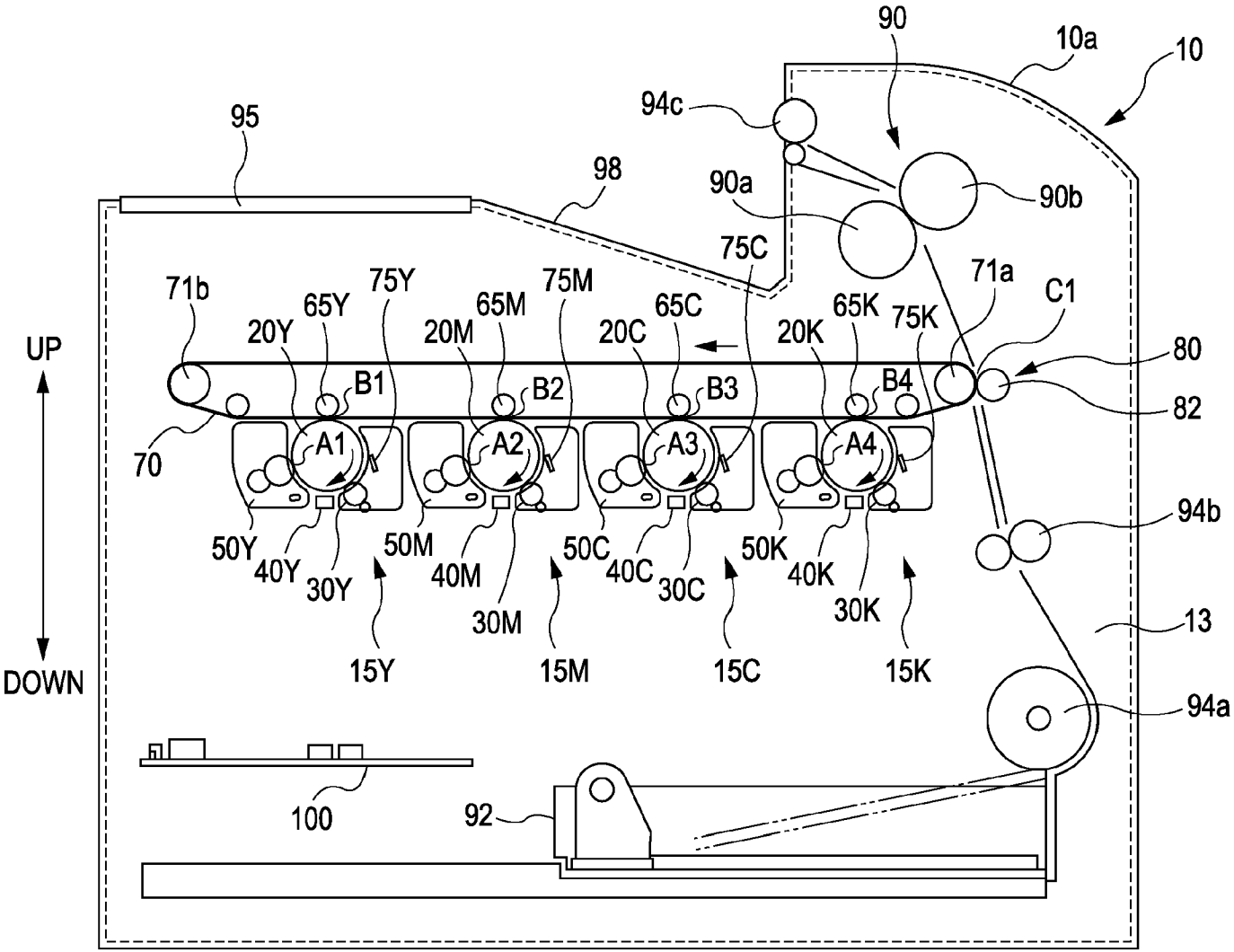
FIG. 1 is a view illustrating an image forming apparatus according to an embodiment of the invention.
Figure 2:
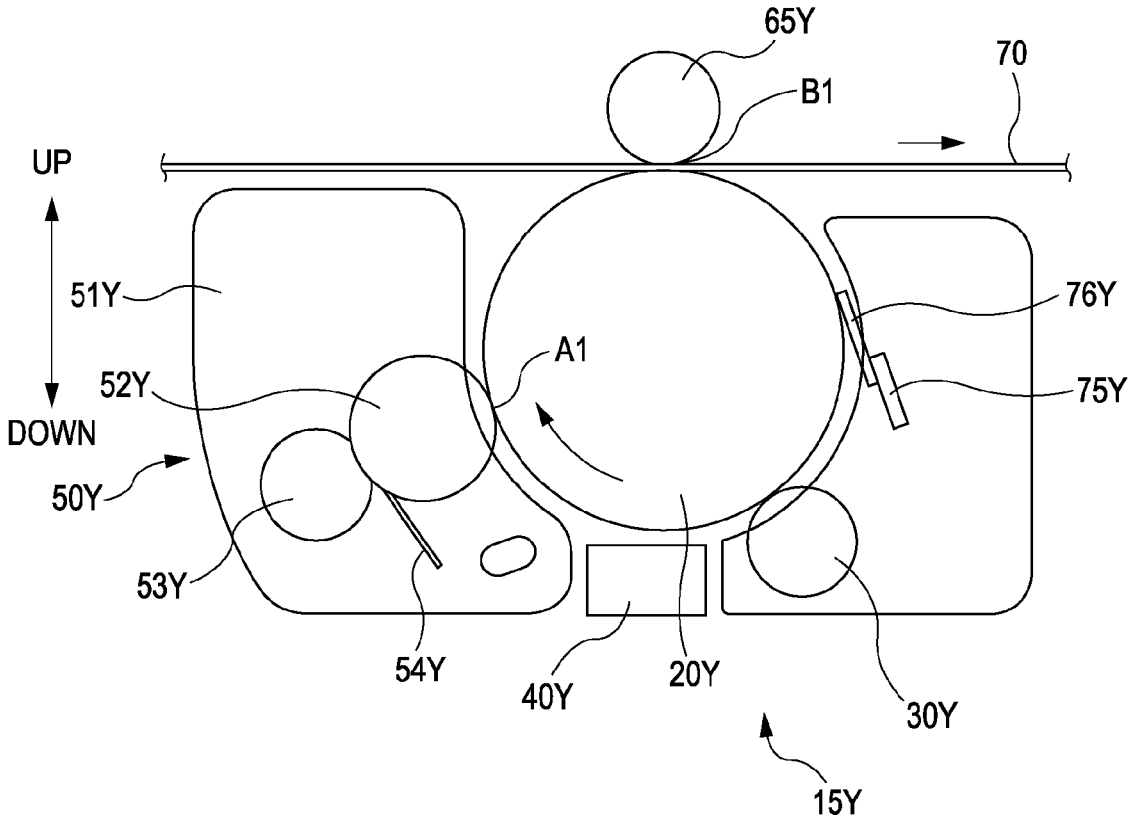
FIG. 2 is a cross-sectional view illustrating the neighborhood of a photoconductor and main constituent components of a developing device.

FIG. 1 is a view illustrating an embodiment of an image forming apparatus including a developing device according to an embodiment of the invention, and FIG. 2 is an enlarged view illustrating a yellow image forming station of FIG. 1.

As shown in FIG. 1, the image forming apparatus includes four image forming stations 15(Y, M, C, and K), an intermediate transfer belt 70, a secondary transfer unit 80, a fixing unit 90, a display unit 95 that serves as an informing unit for a user and is formed of a liquid crystal panel, and a control unit 100 that controls these units to thereby control an operation as an image forming apparatus.

Each of the image forming stations 15(Y, M, C, and K) has a function of forming an image with toner of yellow (Y), magenta (M), cyan (C), and black (K). Since the configurations of the image forming stations 15(Y, M, C, and K) are the same, the image forming station 15Y will now be described.

As shown in FIG. 2, the image forming station 15Y has a charging unit 30Y, an exposure unit 40Y, a developing unit 50Y, a primary transfer portion B1, and a photoconductor cleaning unit 75Y along the rotation direction of a photoconductor 20Y as an example of an image carrier.

The photoconductor 20Y has a cylindrical base and a photosensitive layer formed on an outer peripheral surface of the base and is able to rotate around a central shaft. In the present embodiment, the photoconductor 20Y rotates clockwise as indicated by the arrow.

The charging unit 30Y is a device for electrically charging the photoconductor 20Y. The exposure unit 40Y forms an electrostatic latent image on the electrically charged photoconductor 20Y by irradiating a laser beam.

The exposure unit 40Y has a semiconductor laser, a polygon mirror, an F-θ lens, and the like. The exposure unit 40Y irradiates onto the electrically charged photoconductor 20Y a laser beam modulated on the basis of an image signal input from a host computer (not shown), such as a personal computer and a word processor.

The developing unit 50Y is a device for developing the latent image formed on the photoconductor 20Y using toner of yellow (Y). In the developing unit 50Y, a developing roller 52Y as a developer carrier and a toner supply roller 53Y as a toner supply member are disposed within a development chamber 51Y supplied from a replaceable toner cartridge, which will be described later. A regulation blade 54Y as a regulating member is in contact with the developing roller 52Y in order to make toner on the developing roller 52Y thin.

The primary transfer portion B1 transfers the yellow toner image formed on the photoconductor 20Y onto the intermediate transfer belt 70. In case where the toner of four colors sequentially overlaps to be transferred by four primary transfer portions B1, B2, B3, and B4, a full-color toner image is formed on the intermediate transfer belt 70.

The intermediate transfer belt 70 is an endless belt stretched over a belt driving roller 71*a* and a driven roller 71*b* and is driven to rotate in a state of being in contact with the photoconductor 20(Y, M, C, and K).

The secondary transfer unit 80 is a device for transferring a monochrome toner image or a full-color toner image formed on the intermediate transfer belt 70 onto a transfer material, such as paper, a film, and a cloth.

The fixing unit 90 is configured to include a fixing roller 90*a* and a pressure roller 90*b*. The fixing unit 90 is a device for fixing the monochrome toner image or the full-color toner image transferred onto the transfer material by fusion to thereby make a permanent image.

The photoconductor cleaning unit 75Y has a photoconductor cleaning blade 76Y which is in contact with a surface of the photoconductor 20Y and is formed of rubber. The photoconductor cleaning unit 75Y is a device for removing the toner, which remains on the photoconductor 20Y after the toner image is transferred onto the intermediate transfer belt 70 by the primary transfer portion B1, by scraping using the photoconductor cleaning blade 76Y.

Next, an operation of the image forming apparatus 10 configured as described above will be described.

First, when an image signal and a control signal from a host computer (not shown) are input to a main controller of the image forming apparatus through an interface, the photoconductor 20Y, the developing roller 52Y and the supply roller 53Y provided in the developing unit 50Y, the intermediate transfer belt 70, and the like rotate by control of a unit controller based on the command from the main controller. The photoconductor 20Y is sequentially charged at the charging position by the charging unit 30Y while the photoconductor 20Y is rotating.

An electrically charged region of the photoconductor 20Y reaches the exposure position with rotation of the photoconductor 20Y, and a latent image corresponding to image information of yellow Y is formed in the region by the exposure unit 40Y.

The latent image formed on the photoconductor 20Y reaches the developing position with rotation of the photoconductor 20Y and is developed by the developing unit 50Y. As a result, a toner image is formed on the photoconductor 20Y.

The toner image formed on the photoconductor 20Y reaches the position of the primary transfer portion B1 with rotation of the photoconductor 20Y and is transferred onto the intermediate transfer belt 70 by the primary transfer unit. At this time, a primary transfer voltage which has an opposite polarity to the charging polarity of toner is applied to the primary transfer unit. As a result, the toner images of four colors formed on the photoconductors 20 (Y, M, C, and K) are transferred onto the intermediate transfer belt 70 so as to overlap each other, and a full-color toner image is formed on the intermediate transfer belt 70.

The intermediate transfer belt 70 is driven when a driving force from a belt driving unit, such as a motor, is transmitted through the belt driving roller 71*a*.

The full-color toner image formed on the intermediate transfer belt 70 is transferred onto a transfer material, such as paper, by the secondary transfer unit 80. The transfer material is transported from a paper feed tray to the secondary transfer unit 80 through a paper supply roller 94*a* and a resist roller 94*b*.

The full-color liquid developer image transferred onto the transfer material is heated and pressed by the fixing unit 90 to be fused on the transfer material. After passing the fixing unit 90, the transfer material is discharged by a paper discharge roller 94*c*.

On the other hand, the photoconductor 20(Y, M, C, and K) is discharged by a discharge unit (not shown) after passing the positions of the primary transfer portions B1, B2, B3, and B4. Then, the toner adhered on the surface of the photoconductor 20(Y, M, C, and K) is scraped by the photoconductor cleaning blade 76(Y, M, C, and K) supported on the photoconductor cleaning unit 75(Y, M, C, and K) in order to prepare for electric charging for forming a next latent image. The scraped toner is collected in a remaining toner collecting portion provided in the photoconductor cleaning unit 75(Y, M, C, and K).

An intermediate transfer belt cleaning device (not shown) is provided on a side of the intermediate transfer belt 70 facing the driven roller 71*b* after secondary transfer and cleans the intermediate transfer belt 70 after secondary transfer. In addition, although the above explanation has been made on the basis of an example of the intermediate transfer method using the intermediate transfer belt, a direct transfer type image forming apparatus may also be used.

Next, the developing unit 50Y, particularly, a toner transport structure will be described.

Figure 3:
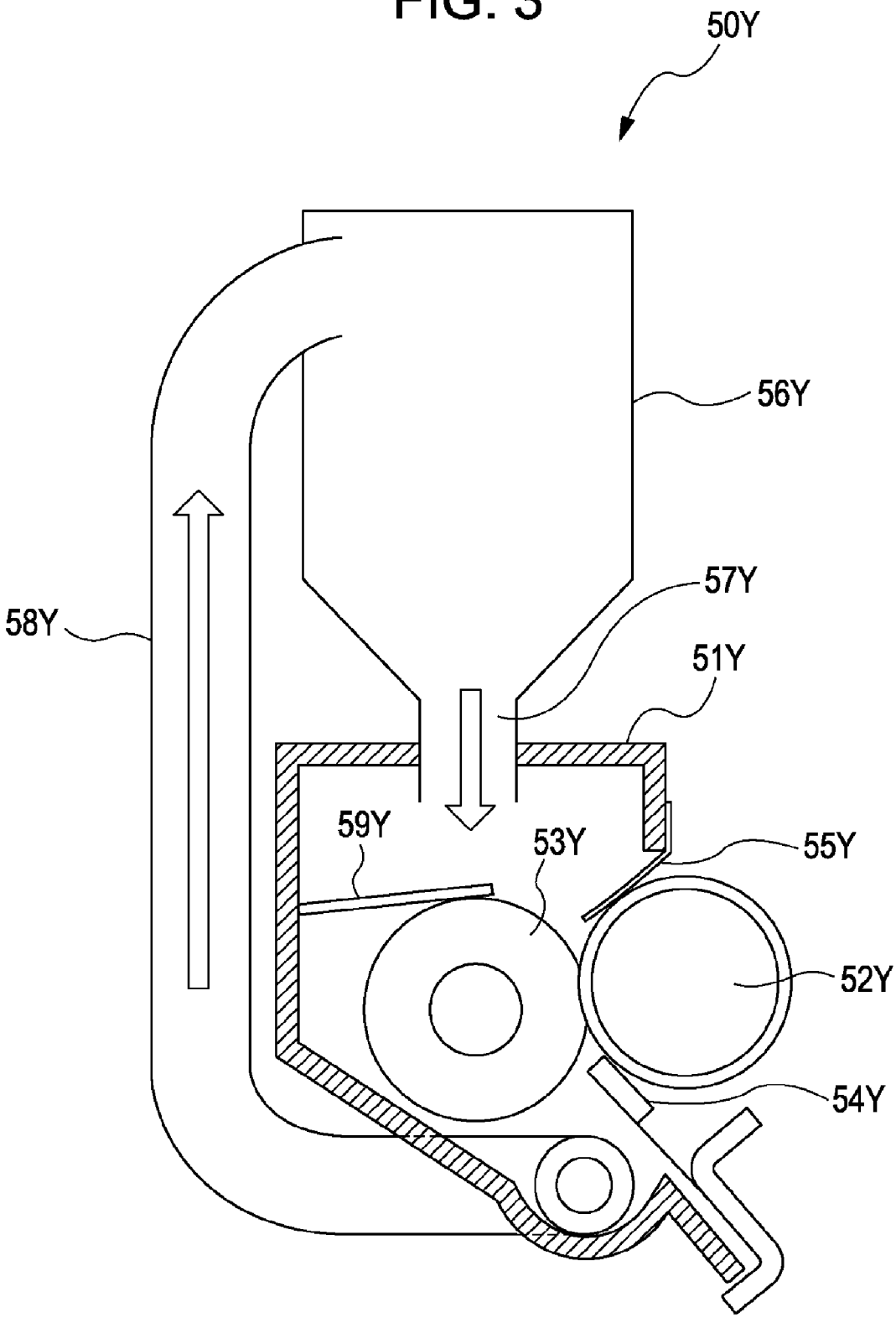
FIG. 3 is a schematic view illustrating the developing device according to the embodiment.

FIG. 3 is a schematic view illustrating the developing unit 50Y according to the embodiment of the invention. As shown in FIG. 3, the developing unit 50Y includes: the development chamber 51Y; the developing roller 52Y that is disposed in the development chamber 51Y and carries toner thereon; the toner supply roller 53Y that is formed of a soft elastic porous body and supplies toner to the developing roller 52Y; the regulation blade 54Y that is in contact with the developing roller 52Y and regulates the amount of toner on the developing roller 52Y in order to make the toner thin; a sealing member 55Y that is used for sealing between the development chamber 51Y and the developing roller 52Y in order to reduce the leakage of toner toward the photoconductor 20Y; a replaceable toner cartridge 56Y; a first transport path 57Y that connects the toner cartridge 56Y and the development chamber 51Y with each other; a second transport path 58Y that connects the development chamber 51Y and the toner cartridge 56Y with each other; and a contact member 59Y that drops toner adhering to the toner supply roller 53Y to a bottom portion of the development chamber 51Y and collects the toner. As a material of the toner supply roller 53Y, polyurethane foam or silicone foam is used. For the toner supply roller 53Y, physical properties that the hardness is low so that the stress against toner is low, permanent pressure distortion is small, and the abrasion resistance of the surface is high are requested. Therefore, it is especially suitable to adopt the polyurethane foam having these physical properties.

Figure 4:
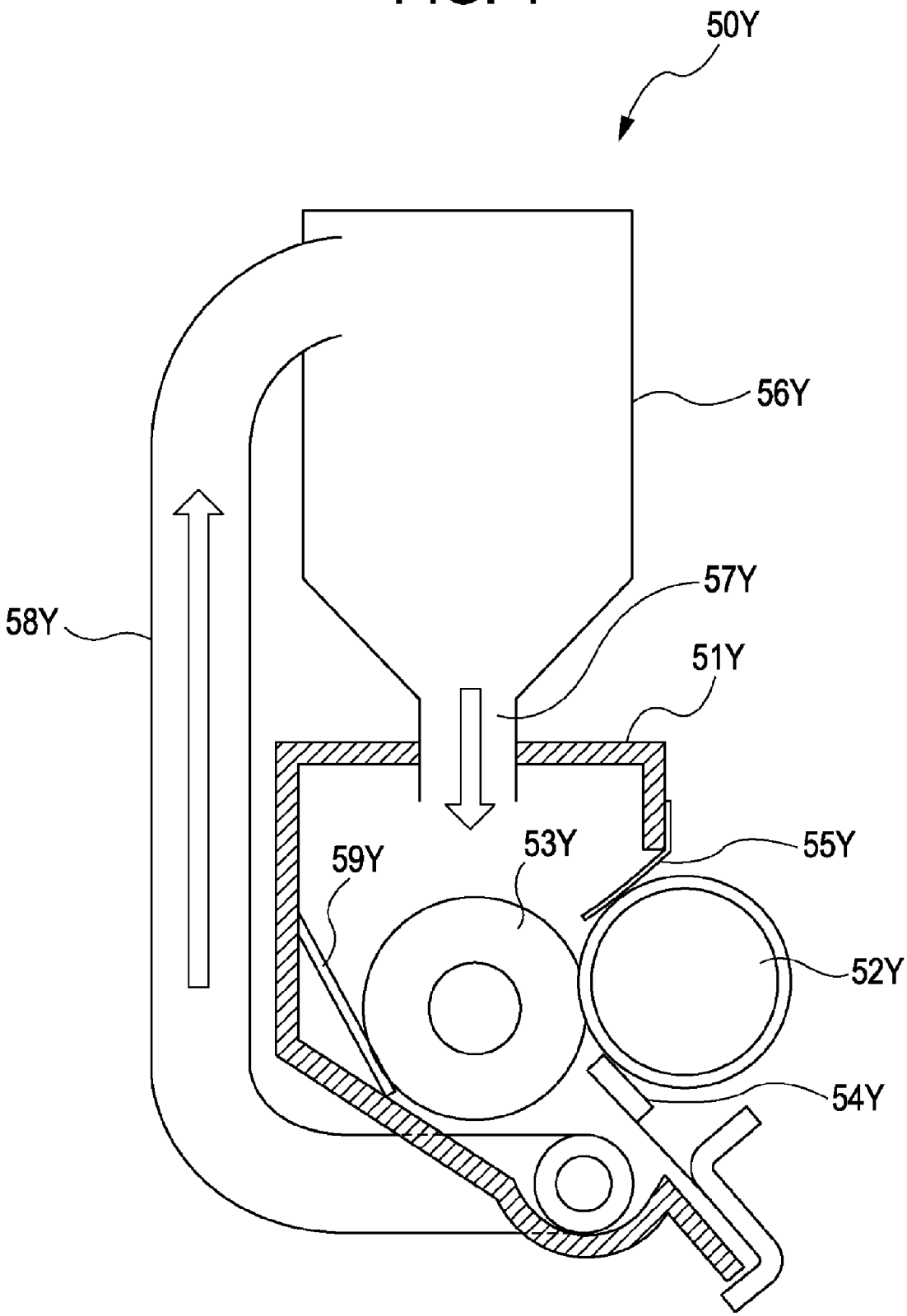
FIG. 4 is a schematic view illustrating the developing device according to the embodiment.

In addition, FIG. 3 shows a case where the contact member 59Y is disposed on the upper side of the toner supply roller 53Y in the gravity direction, and FIG. 4 shows a case where the contact member 59Y on the lower side of the toner supply roller 53Y in the gravity direction. It is preferable to select the arrangement of the contact member 59Y according to the rotation direction of the toner supply roller 53Y. In the case of the arrangement of the contact member 59Y shown in FIG. 3, the contact member 59Y comes in contact with the toner supply roller 53Y in the trail direction with respect to the rotation direction of the toner supply roller 53Y and makes a toner layer on the toner supply roller 53Y uniform at the time of printing. In a state shown in FIG. 3, the toner supply roller 53Y rotates in the clockwise direction which is an opposite direction to the rotation direction of the developing roller 52Y at the time of printing. At the time of collection of remaining deteriorated toner, the contact member 59Y comes in contact with the toner supply roller 53Y in a counter direction with respect to the rotation direction of the toner supply roller 53Y and scrapes the toner layer on the toner supply roller 53Y to drop to the bottom portion of the development chamber 51Y. In the state shown in FIG. 3, the toner supply roller 53Y rotates in the counterclockwise direction which is the same direction as the rotation direction of the developing roller 52Y at the time of collection of toner.

Figure 5A:
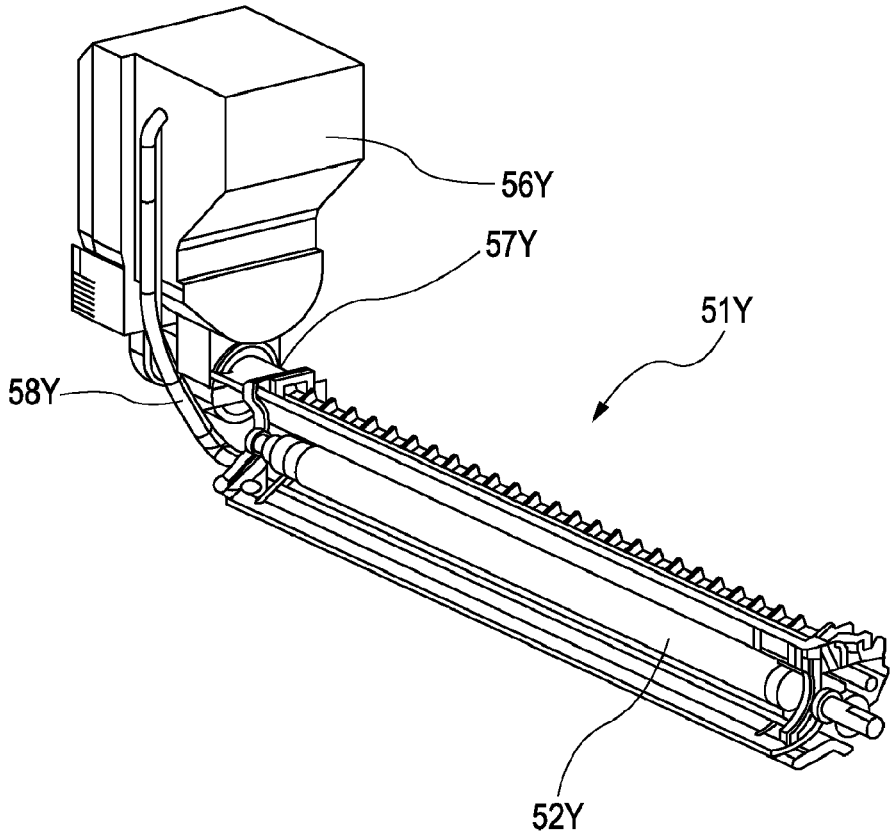
FIGS. 5A and 5B are views illustrating a first example of the developing device according to the embodiment.
Figure 5B:
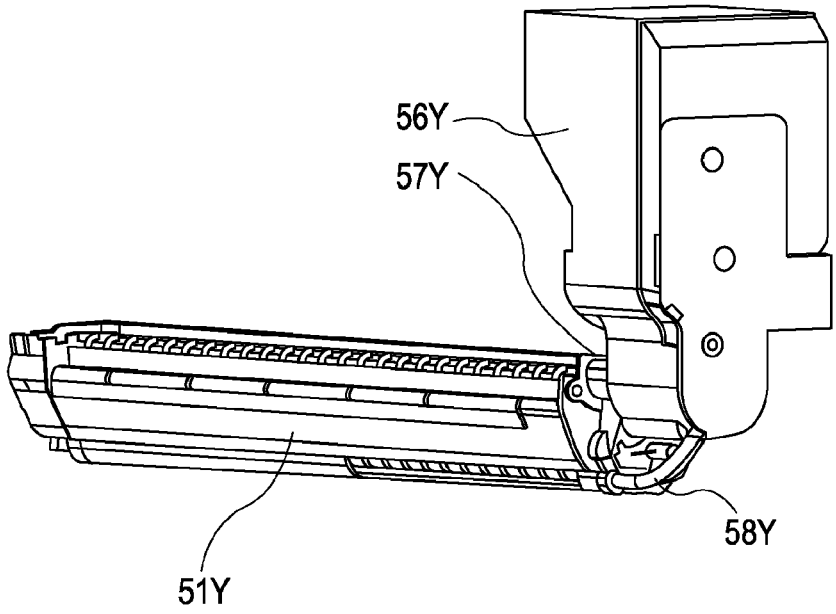
Figure 6A:
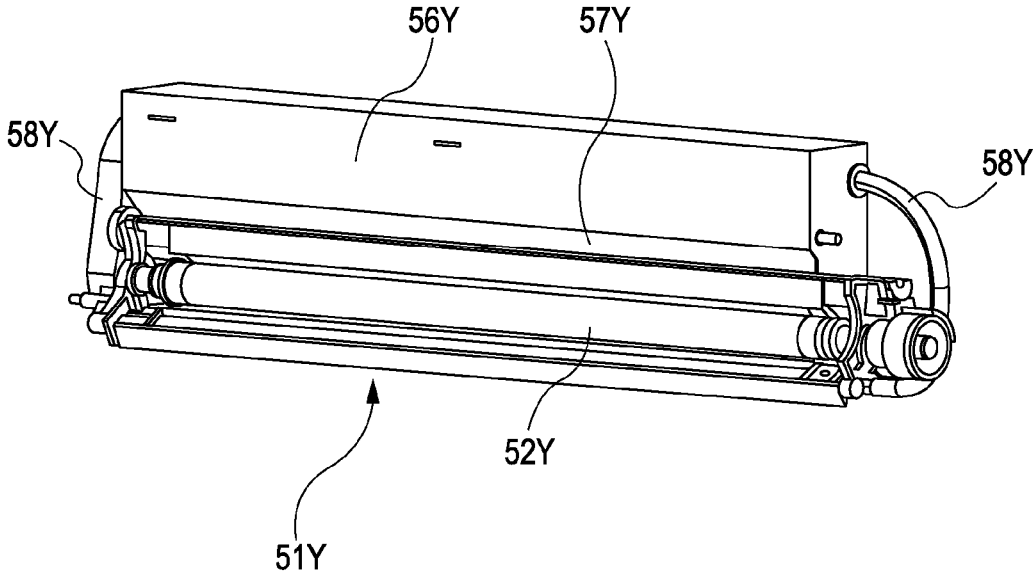
FIGS. 6A and 6B are views illustrating a second example of the developing device according to the embodiment.
Figure 6B:
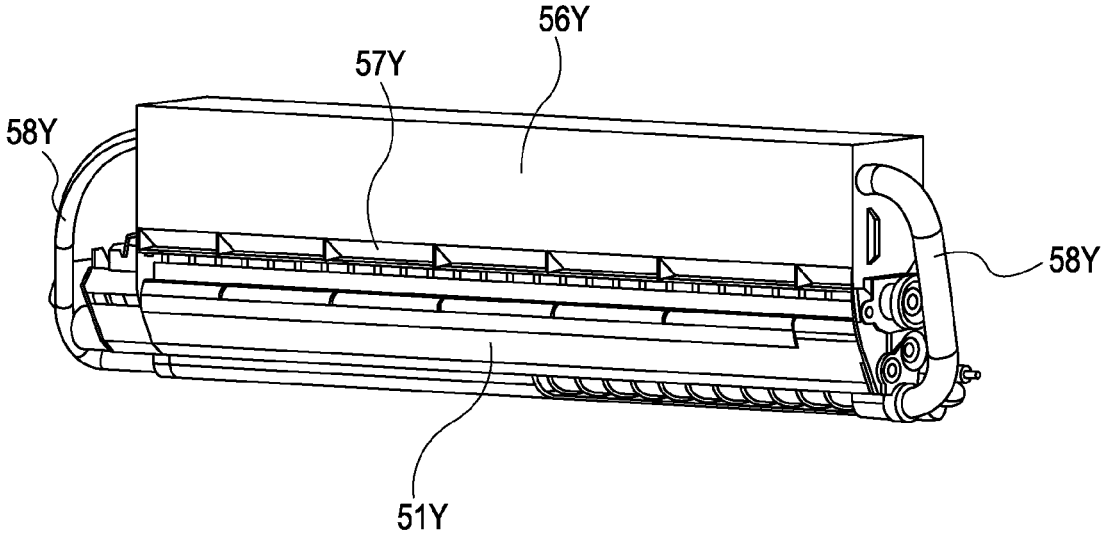

FIGS. 5A and 5B are perspective views illustrating the developing unit 50Y in a first example, and FIGS. 6A and 6B are perspective views illustrating the developing unit 50Y in a second example. The developing unit 50Y shown in FIGS. 5A and 5B has one first transport path 57Y and one second transport path 58Y. On the other hand, the developing unit 50Y shown in FIGS. 6A and 6B has the first transport path 57Y connected to the middle of the development chamber 51Y and the transport paths 58Y connected to both ends of the development chamber 51Y. That is, the developing unit 50Y shown in FIGS. 6A and 6B has two transport paths 58Y.

One end of the first transport path 57Y is connected to an upper portion of the development chamber 51Y in the gravity direction and transports toner from the toner cartridge 56Y to the development chamber 51Y. Supply of the toner, which has passed through the first transport path 57Y from the toner cartridge 56Y, to the development chamber 51Y is executed by driving of a first transport unit (in FIGS. 5A and 5B and 6A and 6B, partially exposed for explanation), such as a screw conveyor, built in the first transport path 57Y. Driving of the first transport unit is ON/OFF controlled.

One end of the second transport path 58Y is connected to a lower portion of the development chamber 51Y in the gravity direction and discharges deteriorated toner from the development chamber 51Y to the toner cartridge 56Y. Discharge of remaining toner from the lower side of the development chamber 51Y to the toner cartridge 56Y is executed by driving of a second transport unit (in FIGS. 5A and 5B and 6A and 6B, partially exposed for explanation), such as a screw conveyor, built in the second transport path 58Y. Driving of the second transport unit is ON/OFF controlled by separate driving from the driving of the first transport unit.

In order to effectively discharge the toner remaining in the development chamber 51Y, a driving unit that makes the toner supply roller 53Y rotate positively or negatively is provided in the present embodiment. In the invention, when the developing roller 52Y rotates counterclockwise at the time of printing, the toner supply roller 53Y rotates in the clockwise direction, which is the opposite direction to the rotation direction of the developing roller 52Y, and supplies toner to the developing roller 52Y. At the time of discharge of remaining toner when replacing the toner cartridge 56Y, the toner supply roller 53Y is made to rotate counterclockwise in order to collect toner adhering on the toner supply roller 53Y. In this case, the developing roller 52Y may be driven to rotate counterclockwise or rotation driving of the developing roller 52Y may be stopped. In any case, toner is not supplied to the photoconductor 20Y. In addition, the toner supply roller 53Y may rotate in any direction at the time of printing or discharge of remaining toner.

Moreover, in order to promote the movement of the toner adhering to the toner supply roller 53Y toward the developing roller 52Y, a toner supply roller bias application unit (not shown) provided separately from the developing roller 52Y is disposed in the toner supply roller 53Y. At the time of discharge of remaining toner, the movement of the toner adhering to the toner supply roller 53Y toward the developing roller 52Y becomes easy by applying a larger bias than a bias value applied from the toner supply roller bias application unit to the developing roller. Particularly in this case, discharge of deteriorated toner adhering to a hole portion of the toner supply roller 53Y, which is formed of a soft elastic porous body, is promoted.

Next, a replacement control at the time of replacement to the toner cartridge 56Y that contains new toner therein will be described.

Figure 7:
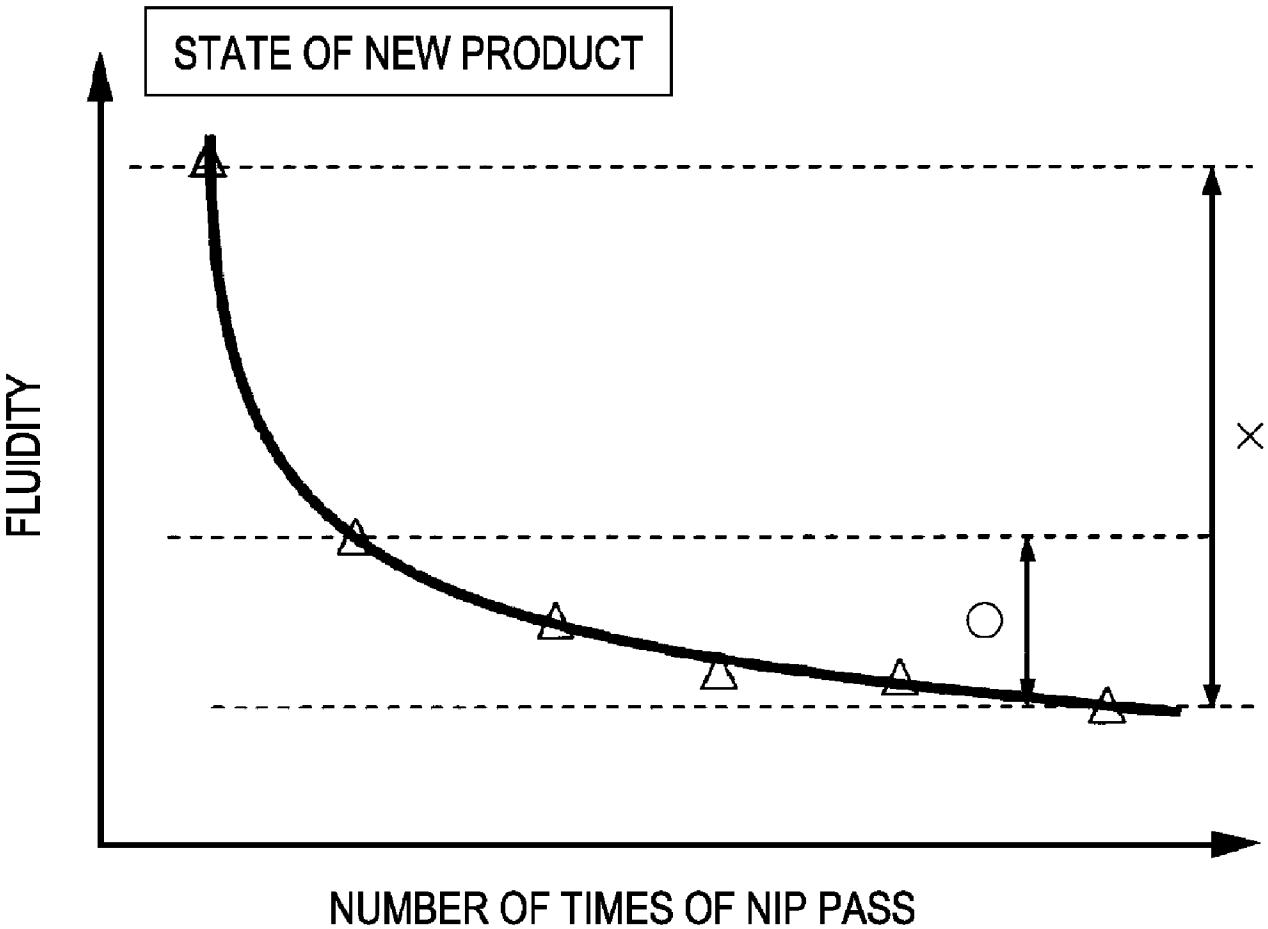
FIG. 7 is a graph illustrating the fluidity of toner to the number of times of nip pass.

FIG. 7 is a graph illustrating the fluidity of toner to the number of times of nip pass. After a new toner is supplied from the toner cartridge 56Y into the development chamber 51Y through the first transport path 57Y, nip-passed toner collected through the second transport path 58Y without being developed in the development chamber 51Y is mixed with the new toner within the toner cartridge 56Y. Since the fluidity or charged amount of the new toner is largely different from that of the nip-passed toner, they is a possibility that fogging will occur to deteriorate an image if printing is performed in a state where the new toner and the nip-passed toner are not stirred well.

As shown in FIG. 7, the fluidity of toner decreases rapidly once the toner passes through a nip at least once from a state of new toner, but the decrease in the fluidity of nip-passed toner is small even if the number of times of nip pass increases thereafter. This is because an additive, such as hydrophobic silica, externally added to base toner particles is buried in the base toner particles due to the mechanical stress applied to the toner when the toner passes through the nip at least once or toner particles with small diameters increase due to crushing of the toner. When toner the fluidity of which has lowered gathers, an agglomerate is generated. This is a cause of deterioration of an output image. Moreover, in the case of toner particles with small diameters, the charged amount thereof is easily increased excessively and the image force onto a latent image carrier works strongly. Accordingly, adhesion (fogging and regulation passing failure) of the toner particles with small diameters onto a non-image area is observed. Thus, when the fluidity of toner drops, the frictional charging of the toner within the developing device becomes insufficient. As a result, toner with an opposite polarity to a desired charging polarity is generated. The toner with the opposite polarity is also observed as fogging of an image. In addition, since toner the fluidity of which has lowered or the agglomerate cannot smoothly pass a contact portion between the developing roller and the regulating member, charging becomes insufficient. This causes fogging of an image. In addition, the agglomerate is fused (so-called filming) on a surface of the developing roller or regulating member by the mechanical force and frictional heat in the contact portion between the developing roller and the regulating member. When the agglomerate is extremely large, the agglomerate clogs the contact portion. As a result, in the contact portion where filming and the like have occurred, a layer of toner is not formed on the developer roller and an image corresponding thereto is observed as white stripes (missing of an image). For this reason, since the fluidity or charged amount of new toner is largely different from that of the nip-passed toner, fogging and the like occur in many cases when the new toner and the nip-passed toner are stirred to be mixed. On the contrary, a difference of fluidities or charged amounts of nip-passed toner particles is small. Accordingly, fogging and the like are reduced when the nip-passed toner particles are stirred to be mixed.

In the present embodiment, in order to reduce deterioration of the image quality caused by such fogging, a replacement mode in which toner is circulated at the time of replacement to the toner cartridge 56Y that contains new toner therein is prepared.

Figure 8:
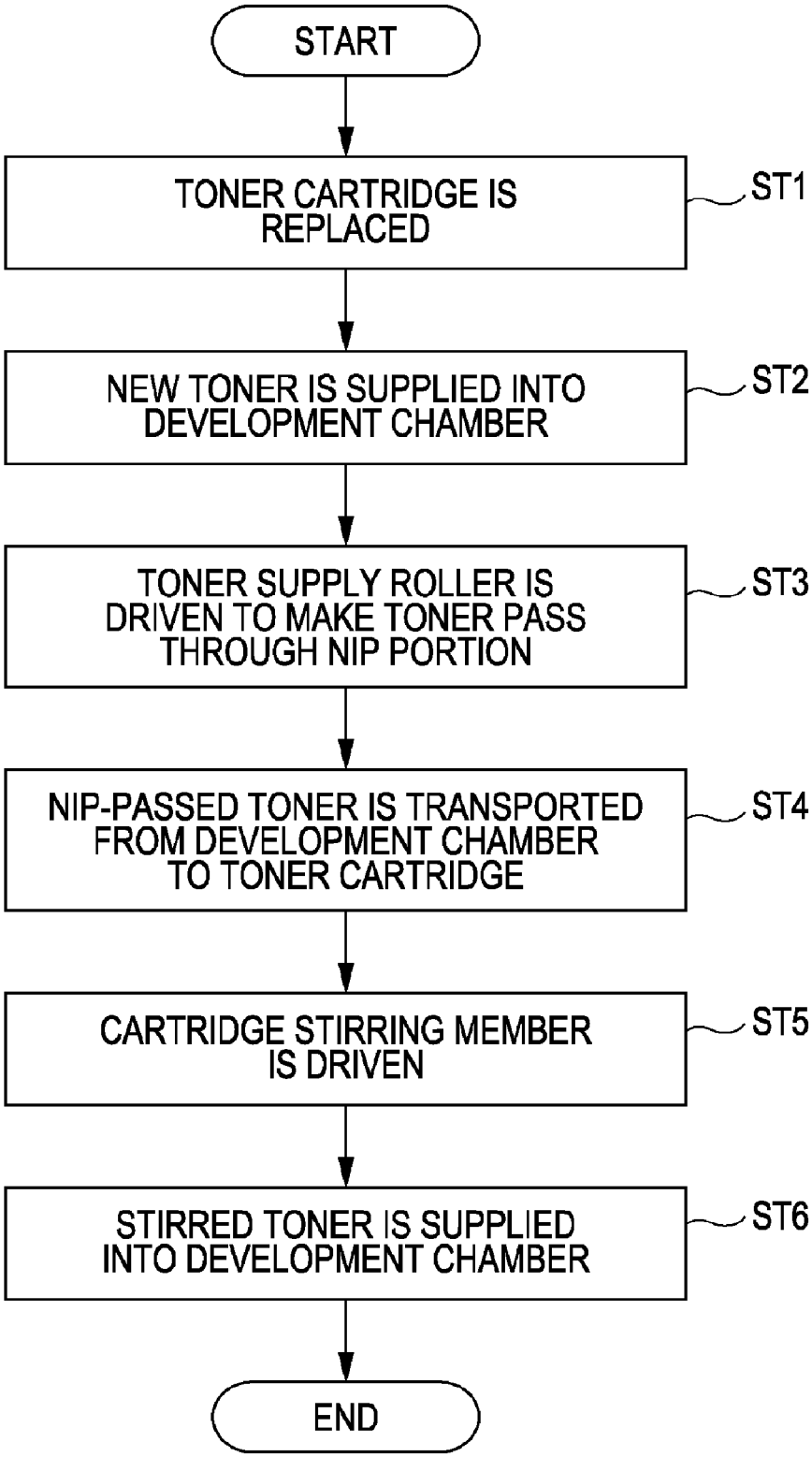
FIG. 8 is a view illustrating the flow of a replacement mode in the embodiment.

FIG. 8 is a view illustrating the flow of the replacement mode in the present embodiment. First, replacement to the toner cartridge 56Y that contains new toner therein is performed in step 1 (ST1). Then, the new toner is supplied from the toner cartridge 56Y into the development chamber 51Y through the first transport path 57Y in step 2 (ST2). The amount of supply of new toner is assumed to be all within the toner cartridge 56Y.

Then, in step 3, the toner supply roller 53Y and the developing roller 52Y are driven for a predetermined time in the development chamber 51Y, such that the new toner passes through a nip portion between the toner supply roller 53Y and the developing roller 52Y as an example of a contact member (ST3). In addition to the developing roller 52Y, it may be possible to provide the contact member 59Y, which is in contact with the toner supply roller 53Y, to form the nip portion by the contact member 59Y so that the new toner passes through the nip portion. In addition, the developing roller 52Y may not be made to rotate.

Then, in step 4, the nip-passed toner that has passed through the nip portion between the toner supply roller 53Y and the developing roller 52Y is transported from the development chamber 51Y to the toner cartridge 56Y through the second transport path 58Y (ST4). Then, in step 5, the nip-passed toner in the toner cartridge 56Y is stirred by driving a cartridge stirring member (not shown) (ST5). Then, in step 6, the stirred toner is supplied into the development chamber 51Y (ST6), completing the circulation mode control. In addition, step 2 (ST2) to step 4 (ST4) continue until all of the new toner pass through the nip portion. In addition, the supply amount and transport amount of toner in each of step 2 (ST2) to step 4 (ST4) is set such that an excessively compact state of toner or an empty state, in which there is no toner in the nip portion between the toner supply roller 53Y and the developing roller 52Y as an example of the contact member does not occur. Moreover, various shapes, such as a propeller shape, a blade shape, and an auger shape, may be used for the cartridge stirring member (not shown).

Thus, the developing device 50Y according to the embodiment of the invention includes: the developing roller 52Y that carries toner thereon; the toner supply roller 53Y that supplies toner to the developing roller 52Y; the regulation blade 54Y that regulates the amount of toner on the developing roller 52Y; the development chamber 51Y having the developing roller 52Y, the toner supply roller 53Y, and the regulation blade 54Y; and the replaceable toner cartridge 56Y that supplies toner to the development chamber 51Y and collects the toner from the development chamber 51Y; and the contact member that is in contact with the toner supply roller 53Y to form the nip portion. Moreover, at the time of replacement to the toner cartridge 56Y that contains new toner therein, new toner is supplied from the toner cartridge 56Y into the development chamber 51Y and is made to pass through the nip portion between the toner supply roller 53Y and the contact member within the development chamber 51Y, and then the nip-passed toner is collected from the development chamber 51Y into the toner cartridge 56Y. Then, a difference between the fluidity or charged amount of the nip-passed toner, which was supplied again from the toner cartridge into the development chamber, and that of deteriorated toner, the charging ability of which has deteriorated since the toner was stirred for a long time by the stirring member, the toner supply roller, and the regulation blade in the development chamber, becomes small. As a result it becomes possible to reduce occurrence of fogging and the like.

In addition, the developing roller 52Y also serves as the contact member. Accordingly, since the number of components is reduced, the cost can be saved.

In addition, since the sealing member 55Y used for sealing between the development chamber 51Y and the developing rollers 52Y is provided and the developing roller 52Y does not rotate at the time of stirring in the development chamber 51Y, the amount of toner leaking toward the photoconductor 20Y can be reduced.

In addition, since the toner supply roller 53Y can rotate positively or negatively around the shaft, the rotation direction may be selected according to the situation.

In addition, the toner cartridge 56Y has a cartridge stirring member, and the cartridge stirring member further stirs the nip-passed toner within the toner cartridge 56Y after collecting the nip-passed toner from the development chamber 51Y into the toner cartridge 56Y. Accordingly, it becomes possible to make the charged amount of toner more uniform.

In addition, since the first transport path 57Y that connects the lower portion of the toner cartridge 56Y and the upper portion of the development chamber 51Y with each other and the second transport path 58Y that connects the lower portion of the development chamber 51Y and the upper portion of the toner cartridge 56Y with each other are provided, it is possible to move toner smoothly.

Moreover, the image forming apparatus according to the embodiment of the invention includes at least the latent image carrier 20 on which an electrostatic latent image is formed, the developing device 50 that develops the electrostatic latent image with a developer to form a toner image on the latent image carrier 20, the transfer unit 80 that transfers the toner image on the latent image carrier 20 onto a transfer material, and the fixing unit 90 that fixes the toner image on the transfer material, and the above-described developing device 50 is mounted. Accordingly, a high-quality image can be formed with an almost uniform charged amount.

While the developing device and the image forming apparatus according to the embodiment of the invention have been described on the basis of the principles and examples thereof, the invention is not limited to the examples but various modifications thereof may also be made.

The entire disclosure of Japanese Patent Application No. 2008-089103, filed Mar. 31, 2008 is expressly incorporated by reference herein.

What is claimed is:

1. A developing device comprising:

a developer carrier that carries toner thereon;

a toner supply member that supplies toner to the developer carrier;

a development chamber having the developer carrier and the toner supply member;

a replaceable toner cartridge that supplies toner to the development chamber and collects toner from the development chamber; and a contact member that is in contact with the toner supply member to form a nip portion, wherein at the time of replacement to the toner cartridge that contains new toner therein, the new toner is supplied from the toner cartridge into the development chamber and is made to pass through a nip portion between the toner supply member and the contact member within the development chamber, and then nip-passed toner is collected from the development chamber into the toner cartridge.

2. The developing device according to claim 1, wherein all of the new toner in the toner cartridge is supplied into the development chamber.

3. The developing device according to claim 1, wherein the developer carrier also serves as the contact member.

4. The developing device according to claim 1, further comprising:

a sealing member used for sealing between the development chamber and the developer carrier, wherein the developer carrier does not rotate at the time of nip pass within the development chamber.

5. The developing device according to claim 1, wherein the toner supply member is rotatable positively or negatively around a shaft.

6. The developing device according to claim 1, wherein the toner cartridge has a cartridge stirring member, and the cartridge stirring member further stirs the nip-passed toner within the toner cartridge after the nip-passed toner is collected from the development chamber into the toner cartridge.

7. The developing device according to claim 1, further comprising:

a first transport path that connects a lower portion of the toner cartridge and an upper portion of the development chamber with each other; and a second transport path that connects a lower portion of the development chamber and an upper portion of the toner cartridge with each other.

8. An image forming apparatus comprising at least:

a latent image carrier on which an electrostatic latent image is formed;

a developing device that develops the electrostatic latent image with a developer to form a toner image on the latent image carrier;

a transfer unit that transfers the toner image on the latent image carrier onto a transfer material; and a fixing unit that fixes the toner image on the transfer material, wherein the developing device according to claim 1 is mounted as the developing device.

* * * * *